US010598078B2

(12) United States Patent
Myers

(10) Patent No.: US 10,598,078 B2
(45) Date of Patent: Mar. 24, 2020

(54) METHOD AND APPARATUS FOR ACTIVE COOLANT VOLUME REDUCTION FOR AUTOMOBILE APPLICATIONS

(71) Applicant: GM GLOBAL TECHNOLOGY OPERATIONS LLC, Detroit, MI (US)

(72) Inventor: John W. Myers, Howell, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 80 days.

(21) Appl. No.: 16/001,076

(22) Filed: Jun. 6, 2018

(65) Prior Publication Data

US 2019/0376440 A1 Dec. 12, 2019

(51) Int. Cl.
*G05D 23/00* (2006.01)
*F01P 7/16* (2006.01)

(52) U.S. Cl.
CPC ..... *F01P 7/165* (2013.01); *F01P 2037/02* (2013.01); *F01P 2060/18* (2013.01)

(58) Field of Classification Search
CPC ..... F01P 7/165; F01P 2037/02; F01P 2060/18
USPC ..... 165/300
See application file for complete search history.

(56) References Cited

U.S. PATENT DOCUMENTS 1,403,493 A * 1/1922 Furber ..... F01P 7/16 123/142.5 R
2012/0168138 A1* 7/2012 Myers ..... F02B 29/0475 165/200
2015/0361864 A1* 12/2015 Wagner ..... F01P 7/08 165/300
2017/0051644 A1* 2/2017 Lagerlof ..... F01M 5/005
2017/0175613 A1* 6/2017 Poisson ..... F01P 7/165
2019/0186336 A1* 6/2019 Lee ..... F16K 31/0624
2019/0301348 A1* 10/2019 Lee ..... F01P 3/02

* cited by examiner

*Primary Examiner* — Claire E Rojohn, III
(74) *Attorney, Agent, or Firm* — Lorenz & Kopf, LLP

(57) ABSTRACT

A method and apparatus for active coolant volume reduction management in a pressurized reservoir coolant diverter for automobile applications. Specifically, an apparatus and method for diverting coolant flow around a pressurized coolant reservoir until the engine has reached operating temperature by employing a coolant bypass chamber and bypass shutoff valve and the like.

20 Claims, 4 Drawing Sheets

200

METHOD AND APPARATUS FOR ACTIVE COOLANT VOLUME REDUCTION FOR AUTOMOBILE APPLICATIONS

BACKGROUND

The present application generally relates to active coolant volume reduction management in a pressurized reservoir coolant diverter for automobile applications. Specifically, the present application teaches an apparatus and method for diverting coolant flow around a pressurized coolant reservoir until the engine has reached operating temperature by employing a coolant bypass chamber and bypass shutoff valve.

DISCUSSION OF THE RELATED ART

Traditionally vehicle cooling systems had a coolant overflow bottle physically attached through use of a hose to the radiator pressure cap area where an extra coolant volume was located for management of coolant expansion and contraction and purging of any air located in the cooling system. The pressure cap usually was located in the highest point of the system and thus was a good location for many years. As vehicle cooling systems become more complex and front end structures become lower than the engine the traditional overflow bottle system has been eliminated with the use of pressurized coolant reservoirs. The advantage of the pressurized system is that the coolant fill point can now be located anywhere under hood but requires that all of the coolant that was once separated from the main cooling system to now be included into the active portion of the cooling system during engine warm up so the engine warm up is delayed until this extra coolant volume has been warmed up. In this configuration the coolant tank inlet temperature is approximately the same temperature as the engine out coolant temperature. Thus, the tank coolant is warming up during the vehicle engine warm up cycle and decreasing overall fuel economy during cold engine warm up conditions. It would be desirable to overcome these problems while maintaining benefits of the pressurized reservoir system.

SUMMARY

Embodiments according to the present disclosure provide a number of advantages. For example, embodiments according to the present disclosure may enable improved performance of vehicle cooling systems and quicker performance in reaching optimal operating temperatures, both for propulsion system performance and vehicle occupant safety and comfort. Embodiments according to the present disclosure may thus be more robust than previous cooling systems, thereby increasing customer satisfaction The present disclosure describes an apparatus comprising a coolant tank having a first chamber and a second chamber, an inlet coupled to the first chamber, an outlet coupled to the second chamber, a bypass coupled between the first chamber and the outlet, a sensor for determining a temperature of a fluid within the first chamber, and a valve for coupling the fluid within the first chamber to the bypass in response to the temperature of the fluid being below a first temperature, the valve further operative to couple the fluid within the first chamber to the second chamber in response to the temperature of the fluid being greater than the first temperature.

Another aspect of the present disclosure describes a method comprising receiving a coolant having a temperature from a vehicle coolant circulation system, coupling the coolant to a reservoir bypass coupled to an outlet, determining the temperature of the coolant, and coupling the coolant to a reservoir coupled to the outlet in response to the temperature being greater than a threshold temperature Another aspect of the present disclosure describes an active liquid reservoir comprising an inlet for receiving a liquid having a first temperature, an outlet, a first tank coupled to the inlet, a second tank coupled to the outlet, and a thermostat coupled to the first tank, the second tank and the outlet, for determining the first temperature and directing the fluid from the first tank to the second tank in response to the first temperature exceeding a threshold, the thermostat being further operative to direct the fluid to the outlet in response to the first temperature not exceeding the threshold.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a vehicle coolant system is merely exemplary in nature, and is in no way intended to limit the invention or its applications or uses. For example, the cooling system of the present disclosure is described as having application for a vehicle. However, as will be appreciated by those skilled in the art, the architecture may have applications other than automotive applications.

Figure 1:
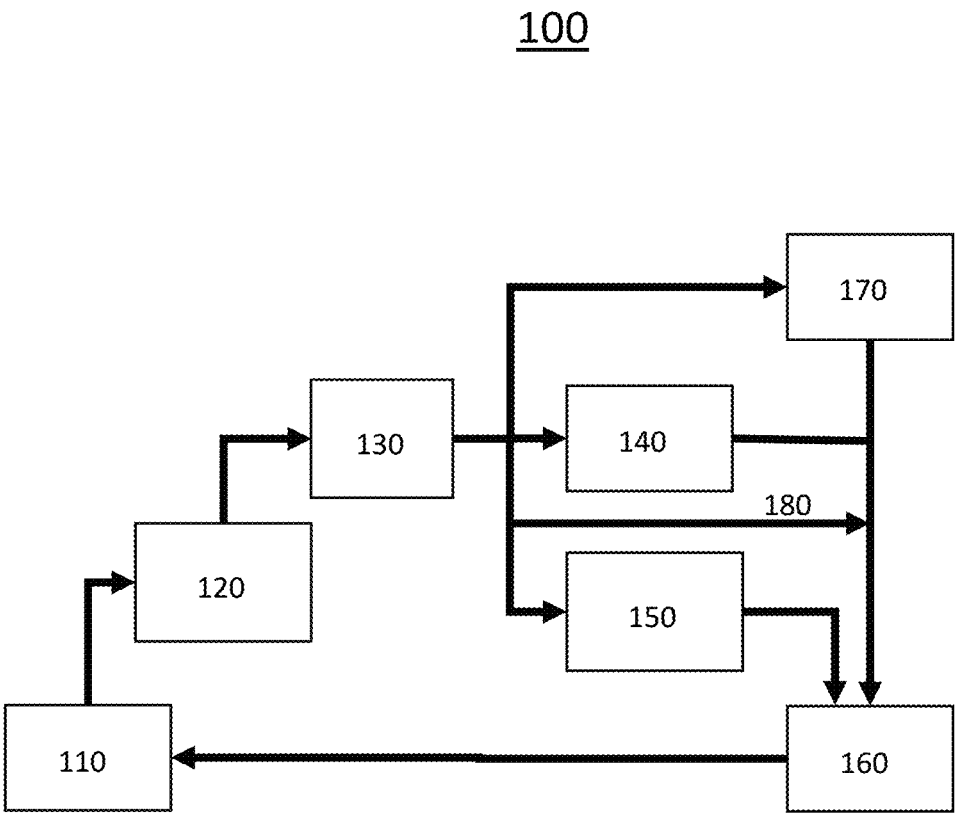
FIG. 1 shows a block diagram of an exemplary application for an active coolant volume reduction for automobile applications.

Turning now to FIG. 1, a block diagram of an exemplary application for an active coolant volume reduction for automobile applications according to the present disclosure is shown. Modern vehicle cooling systems are typically pressurized to take advantage of the thermal efficiencies of internal combustion engines in order to increase the boiling point of coolant. Modern vehicle design has made location of a traditional coolant radiator cap at the highest point of the coolant circuit problematic. Traditional coolant overflow bottles have typically been connected to the radiator cap. Another disadvantage of current pressurized coolant reservoirs is that the entire volume of coolant is included in the active portion of the cooling system, and therefore the time to reach optimal operating temperature is delayed until the extra coolant volume is warmed.

The exemplary coolant system 100 comprises a coolant pump 110, a vehicle engine block 120, a temperature sensor 130, a heater core 140, a radiator 150, an active coolant volume management device 170 and a suction side thermostat 160. The coolant pump 110 is operative to circulate coolant throughout the coolant system 100. The coolant pump 110 may employ an impeller pump wheel or the like, enclosed within a housing with an inlet and an outlet for coolant flow. The coolant pump 110 may be driven mechanically via a serpentine belt or the like, which in turn is attached to a pulley driven in response to engine crank rotation or may be an electric pump operated independently from the engine rotation speed.

The vehicle engine block 120 houses the pistons, cylinders, valves and crank shaft and is the primary source of heat in a vehicle as a result of internal combustions. The pressurized coolant is pumped through channels within the vehicle engine block 120 and head. Heat is conducted from the metal surfaces of the engine block 120 to the pressurized coolant. The heated pressurized coolant flows by a temperature sensor 130 for determining the temperature of the pressurized coolant. Additionally, a heater core 140 may be used to radiate heat from the pressurized coolant into the passenger compartment. A radiator 150, is also employed to extract heat from the pressurized coolant and transfer the heat to the air outside of the vehicle. The coolant flow through the radiator 150 may also be controlled by a suction side thermostat 160.

The pressurized coolant reservoir 170 is operative to store an extra volume of coolant for management of coolant expansion and contraction as the vehicle heats up and cools down. The pressurized coolant reservoir 170 comprises two chambers, a smaller coolant bypass chamber and a larger surge tank chamber. The coolant bypass chamber is operative to store a small amount of coolant and is operative to divert the coolant flow around the surge tank chamber until the engine has reached operating temperature. This has the beneficial result that the engine warm up will be faster during the least efficient portion of the engine operation and fuel economy and cabin warm up improvements will be realized. Another benefit of the proposed pressurized coolant reservoir 170 is that it facilitates removal of air from the coolant circuit during engine operation and the system fill process.

The exemplary coolant system 100 may further include a coolant bypass circuit 180 which may be used to maintain proper overall engine coolant flow when the suction side thermostat 160 is restricting coolant flow from the radiator 150. The suction side thermostat 160 is operative to determine the temperature of the coolant in the cooling circuit while coolant system is warming up to its operating temperature. When the coolant temperature reaches its operative temperature, it starts to allow coolant to flow from the radiator to mix with the cooling circuit to maintain the operating temperature. If higher temperatures are determined, the suction side thermostat 160 will facilitate greater flow through the radiator and a reduced flow through the radiator for lower temperatures.

Figure 2:
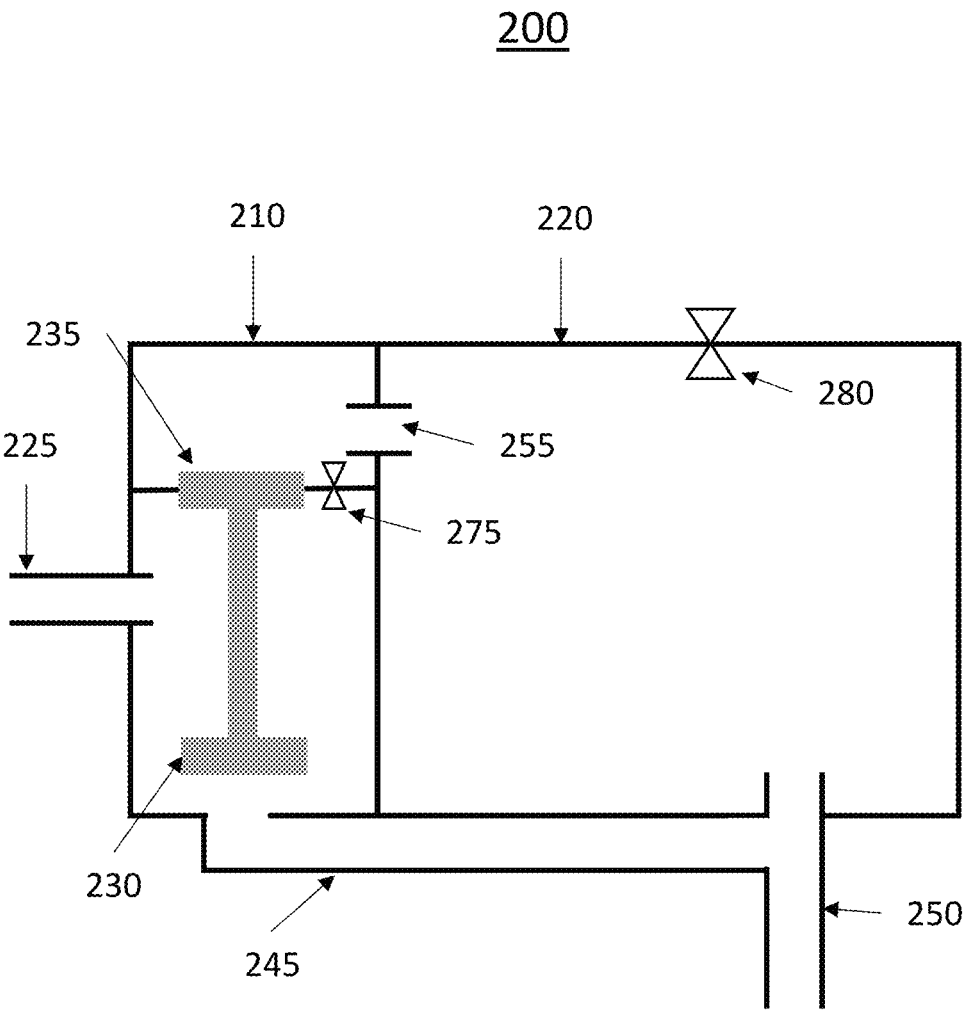
FIG. 2 shows a schematic cross section of an exemplary active coolant management device.

Turning now to FIG. 2, a schematic cross section of an exemplary active coolant management device 200 is shown. The active coolant management device primarily includes two coolant storage chambers, a coolant bypass chamber 210 and a surge tank chamber 220. The coolant bypass chamber 210 is a smaller chamber which houses a valve mechanism having a bypass shutoff valve 230 and a main thermostatic valve 235. The active coolant management device 200 is operative to receive coolant from the coolant circulation system at an inlet pipe 225 and to divert coolant to a coolant bypass circuit 245 during vehicle warmup, and once the vehicle coolant reaches an operating temperature, to direct coolant to the surge tank chamber 220. The surge tank chamber 220 contains a volume of coolant used to compensate for coolant expansion and contraction and is the accumulation point for any purged air from the cooling system.

The coolant bypass chamber 210 houses the thermostatic mechanism including the bypass shutoff valve 230 and a main thermostatic valve 235. When the thermostatic mechanism is in bypass mode, the bypass shutoff valve 230 is open and the main thermostatic valve 235 is closed, and the coolant is directed through the coolant bypass circuit 245 to an outlet pipe 250. Once the coolant reaches a desired operating temperature, the thermostatic mechanism is operative to open the main thermostatic valve 235 and close the bypass shutoff valve 230 in order to direct the coolant through a coolant and air passage 255 and into the surge tank chamber 220. The coolant then mixes with an additional quantity of coolant stored in the surge tank chamber 220, warming the additional quantity of coolant. The coolant then flows through the outlet pipe 250 back into the coolant circulation system. The outlet pipe optionally have a valve to prevent backflow from the coolant bypass circuit 245 which is closed during bypass mode. The thermostatic mechanism may optionally be replaced by a valve system switched by a temperature sensor such as a thermocouple and microprocessor or the like.

The active coolant management device 200 may further employ a first pressure valve 275 to permit air to flow into the surge tank 220 thorough the coolant and air passage 255 but will restrict the flow of coolant to pass by. The air separated out of the cooling system into the surge tank 220 may be pushed to atmosphere pressure through the second pressure valve 280. The exemplary coolant system further includes a first pressure relief valve 275 such as a float valve or a jiggle valve, and a second pressure release valve 280, such as a pressure valve or a pressure cap, which may be used to separate trapped air in the coolant circuit and within the pressurized coolant reservoir. If a pressure cap is employed as the second pressure relief valve 280, it may be used to fill the system with coolant.

Figure 3A:
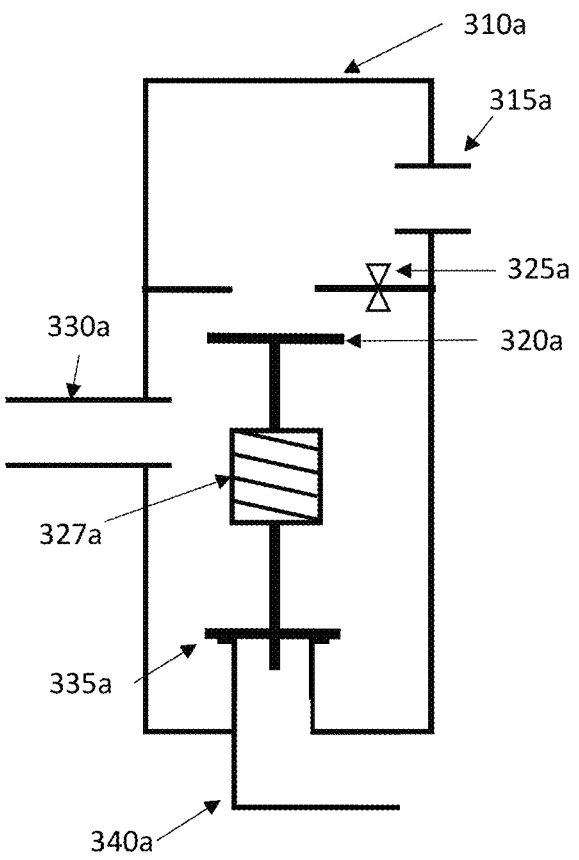
FIG. 3*a* shows a cross section of an exemplary coolant bypass chamber 310*a* with thermostatic mechanism in a normal operating mode.

Turning now to FIG. 3*a*, a cross section of an exemplary coolant bypass chamber 310*a* with thermostatic mechanism in normal operating mode is shown. In normal operation mode, the coolant is operative to flow in from the coolant circulation system via the inlet pipe 330*a* into the coolant bypass chamber 310*a*. The main thermostatic valve 320*a* is in the open position and the bypass shutoff valve 335*a* is shown in the closed position. The coolant then flows to the upper portion of the coolant bypass chamber and through a coolant and air passage 315*a* and into the surge tank chamber. In this mode, no coolant flows through the coolant bypass circuit 340*a*. In an exemplary embodiment, at least one of the main thermostatic valve 320*a* and the bypass shutoff valve 335*a* may be wax pellet thermostatic valve 327*a* or the like. The coolant bypass chamber 310*a* may further employ a jiggle valve or float valve 325*a* for deaeration primarily during the bypass mode and service fill.

Figure 3B:
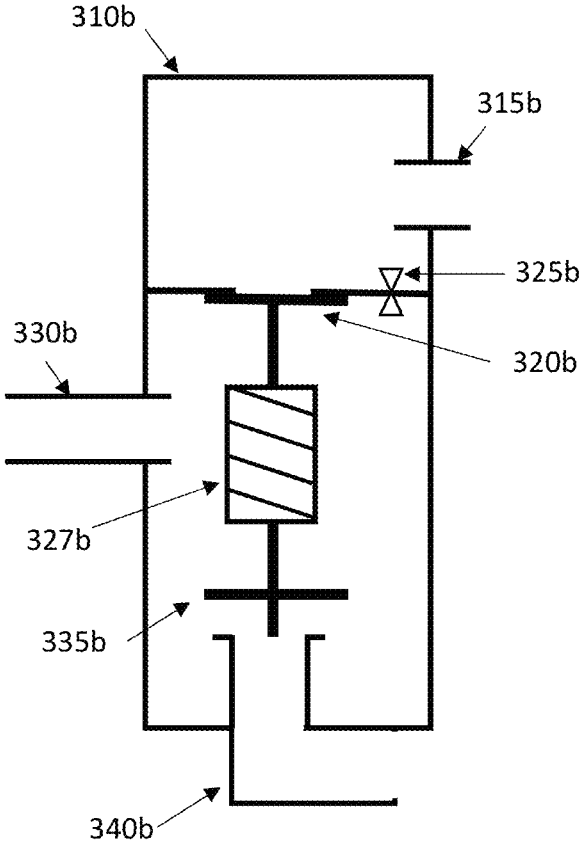
FIG. 3*b* shows a cross section of an exemplary coolant bypass chamber with thermostatic mechanism in a bypass mode.

FIG. 3*b* is illustrative of a cross section of an exemplary coolant bypass chamber with thermostatic mechanism 310*b* in bypass mode is shown. In bypass or warmup operation mode, the coolant is operative to flow in from the coolant circulation system via the inlet pipe 330*b* into the coolant bypass chamber 310*b*. The main thermostatic valve 320*b* is shown in the closed position and the bypass shutoff valve 335*b* is shown in the open position. In an exemplary embodiment, these valves may be actuated in response to a wax pellet thermostatic valve 327*b* or the like. In the bypass mode, the coolant flows through the coolant bypass circuit 340*b* to be recirculated by the coolant circulation system and bypasses the surge tank chamber. In this mode, no coolant flows through the coolant and air passage 315*b* or the surge tank chamber. The coolant bypass chamber 310*a* may further employ a jiggle valve or float valve 325*b* between the lower and upper coolant bypass chamber 310*b* in order to allow for any needed air to pass during coolant fill and deaeration during cold and warm up coolant ambient conditions while blocking coolant flow during these conditions.

The exemplary wax pellet thermostatic valve 327*a*, 327*b* may be formed using a rigid housing encasing a pin valve driven by a copper loaded wax pellet inside a sealed body. As the temperature of the coolant increases, the wax expands, expanding the sealed body driving the pin valve. In this exemplary embodiment, the expanding sealed body may actuate the opening of the main thermostatic valve 320*a*, 320*b* and the closing of the bypass shutoff valve 335*a*, 335*b* wherein the contracting sealed body may actuate the closing of the main thermostatic valve 320*a*, 320*b* and the opening of the bypass shutoff valve 335*a*, 335*b*.

Benefits of the proposed system with the coolant bypass chamber include increased faster Engine warm up, increased engine fuel economy, and faster cabin warm up during cold conditions. In addition, engine oil and transmission oil warm up will be improved using Stack Plate Heat Exchangers (SPHE).

Figure 4:
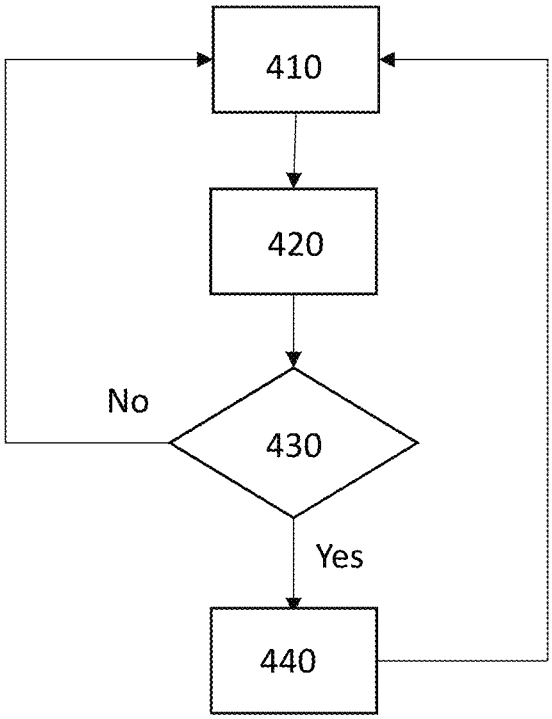
FIG. 4 shows an exemplary method for active coolant volume reduction for automobile applications.

Turning now to FIG. 4, an exemplary method for active coolant volume reduction for automobile applications 400 is shown. The method is first operative to receive a coolant having a temperature from a vehicle coolant circulation system 410. The method is then operative to couple the coolant to a reservoir bypass chamber coupled to an inlet 420. The method is then operative to determine the temperature of the coolant 430. If the temperature of the coolant exceeds a threshold temperature, the method is then operative to couple the coolant to a reservoir coupled to the bypass chamber in response to the temperature being greater than a threshold temperature 440. The method then returns to receiving a coolant having a temperature from a vehicle coolant circulation system 410. If the temperature of the coolant does not exceed the threshold temperature, the method is operative to continue to couple the coolant back to the vehicle coolant circulation system 410 through the reservoir outlet.

The method may be further operative to couple the coolant to the reservoir bypass is performed in response to the temperature of the coolant being less than the threshold temperature, wherein the coolant is coupled to at least one of the reservoir and the reservoir bypass by a thermostat. The method may be operative to determine the temperature of the coolant in response to a temperature sensor. The reservoir may contain an additional volume of vehicle coolant to be used by the vehicle coolant circulation system after the coolant had reached a threshold temperature. The threshold temperature may be determined in response to an operating temperature of a vehicle propulsion system.

In addition, while the previously discussed exemplary embodiments describe the coolant bypass chamber and a surge tank chamber collocated, the two tanks may optionally be located in separate locations and connected via a hose or the like. While a wax pellet thermostat was described in the exemplary embodiment, the system may be implemented with electronic valves controlled by an engine coolant temperature sensor and activated by engine control modules or the like.

The foregoing discussion disclosed and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An active liquid reservoir comprising:

an inlet for receiving a liquid having a first temperature;

an outlet;

a first tank coupled to the inlet;

a second tank coupled to the outlet;

a first pressure valve configured to allow air flow from the first tank and the second tank;

a second pressure valve configured to release air from the second tank to outside of the active liquid reservoir; and a thermostat coupled to the first tank, the second tank and the outlet, for determining the first temperature and directing the liquid from the first tank to the outlet via the second tank in response to the first temperature exceeding a threshold, the thermostat being further operative to direct the liquid from the first tank to the outlet via a bypass circuit in response to the first temperature not exceeding the threshold, where the bypass circuit bypasses the second tank.

2. The active liquid reservoir of claim 1 wherein a volume of the first tank is less than a volume of the second tank.

3. The active liquid reservoir of claim 1 wherein the thermostat is a wax pellet thermostat.

4. The active liquid reservoir of claim 1 wherein active liquid reservoir is part of a pressurized vehicle coolant circulation system.

5. The active liquid reservoir of claim 1 wherein the liquid is a coolant for a vehicle cooling system.

6. The active liquid reservoir of claim 1 wherein thermostat is operative to open a valve between the first tank and the second tank in response to the first temperature exceeding the threshold.

7. The active liquid reservoir of claim 1 wherein the thermostat is operative to couple the liquid to a bypass for bypassing the second tank in response to the temperature not exceeding the threshold.

8. The active liquid reservoir of claim 1 further comprising a heater core coupled to the outlet.

9. An apparatus comprising:

a coolant tank having a first chamber and a second chamber;

a first pressure valve configured to allow air flow between the first chamber and the second chamber;

a second pressure valve configured to allow air flow between the second chamber to outside of the coolant tank;

a fluid inlet coupled to the first chamber;

a fluid outlet coupled to the second chamber;

a fluid bypass coupled between the first chamber and the outlet;

a sensor for determining a temperature of a fluid within the first chamber; and a valve for coupling the fluid within the first chamber to the fluid bypass in response to the temperature of the fluid being below a first temperature where the fluid bypass bypasses the second chamber, the valve further operative to couple the fluid within the first chamber to the fluid outlet via the second chamber in response to the temperature of the fluid being greater than the first temperature.

10. The apparatus of claim 9 wherein a volume of the first chamber is less than a volume of the second chamber.

11. The apparatus of claim 9 wherein the sensor is a thermostat.

12. The apparatus of claim 9 wherein the valve is a thermostat.

13. The apparatus of claim 9 wherein the fluid is a coolant for a vehicle cooling system.

14. The apparatus of claim 9 wherein the sensor is operative to generate a control signal to open the valve between the first chamber and the second chamber in response to the first temperature exceeding a threshold.

15. The apparatus of claim 9 further comprising a heater core coupled to the outlet.

16. A method comprising:

receiving a coolant having a temperature from a vehicle coolant circulation system;

coupling the coolant to a reservoir bypass coupled to an outlet;

determining the temperature of the coolant;

coupling a first air pressure from the vehicle coolant circulation system;

coupling the coolant to a reservoir coupled to the outlet in response to the temperature being greater than a threshold temperature; and coupling a second air pressure from the reservoir outside of the vehicle circulation system.

17. The method of claim 16 further wherein coupling the coolant to the reservoir bypass is performed in response to the temperature of the coolant being less than the threshold temperature.

18. The method of claim 16 wherein coolant is coupled to at least one of the reservoir and the reservoir bypass by a thermostat.

19. The method of claim 16 wherein the temperature is determined in response to a temperature sensor.

20. The method of claim 16 wherein the reservoir contains an additional volume of vehicle coolant.

* * * * *